US009901182B1

(12) United States Patent
Allbee

(10) Patent No.: US 9,901,182 B1
(45) Date of Patent: Feb. 27, 2018

(54) ANKLE PROTECTION DEVICE

(71) Applicant: Mark Allbee, Salem, NH (US)

(72) Inventor: Mark Allbee, Salem, NH (US)

( * ) Notice: Subject to any disclaimer, the term of this patent is extended or adjusted under 35 U.S.C. 154(b) by 0 days.

(21) Appl. No.: 15/398,414

(22) Filed: Jan. 4, 2017

(51) Int. Cl.
*A47C 16/02* (2006.01)

(52) U.S. Cl.
CPC ..... *A47C 16/02* (2013.01)

(58) Field of Classification Search
CPC ..... A47C 16/02
See application file for complete search history.

(56) References Cited

U.S. PATENT DOCUMENTS 4,326,299 A * 4/1982 Bednar ..... A63B 71/1225 2/22 X
5,823,195 A * 10/1998 Shook ..... A61F 13/066 128/893
5,882,324 A * 3/1999 Baranowski ..... A61F 13/069 128/889 X
6,920,881 B2 * 7/2005 Narula ..... A61F 5/0195 128/889

* cited by examiner

*Primary Examiner* — Anthony D Barfield
(74) *Attorney, Agent, or Firm* — Taylor English Duma LLP

(57) ABSTRACT

An ankle protection device includes: an upper surface including a sloping portion having a substantially frusto-conical shape, the sloping portion angled with respect to a flat portion of the lower surface at a slope angle measuring in the range of about 10 degrees to about 80 degrees; a lower surface distal from the upper surface; an upper cavity defined in the upper surface and sized to receive at least one of a medial malleolus and a lateral malleolus of a human ankle; a lower cavity defined in the lower surface; and a resilient material.

20 Claims, 10 Drawing Sheets

ANKLE PROTECTION DEVICE

TECHNICAL FIELD

Field of Use

This disclosure relates to devices that support a portion of a person's body. More specifically, this disclosure relates to a device configured as a cushioning pad to support a person's ankle while the person is seated.

Related Art

A variety of devices such as chairs and seat cushions have been developed to support portions of the human body. While the human body itself is well designed for many different environments and in some areas incorporates its own protective cushioning features, man-made support devices can reduce the stresses experienced by the human body and can even facilitate healing of those parts that are worn from constant use. Moreover, certain portions of the human body are not as naturally suited for the surfaces with which people interact.

The preferred seating position in many parts of the world including Asia, the Middle East, Africa, and the South Pacific, is a cross-legged position or a side-legged position on the floor. These seating positions can generate damaging stress on the human body—stress that can adversely affect portions of the body including bones, soft tissues, and skin of the ankles due to prolonged contact with hard or rough surfaces or due to unnecessary bending of joints such as the ankle joint. Over time, such prolonged contact can cause a person to experience pain, discoloration, sores, scarring, and/or disfigurement in or around the ankle, any of which can become permanent. In some cases a portion of the ankle can become severely reddened or a portion of a bone itself can become exposed when the skin retreats due to incessant irritation. These ankle-related maladies can persist and worsen because the average person, while at work or at home, will typically be in a seated position many hours per day, day after day. The seating preference itself therefore can become not only the initial cause of the damage but can act to prevent any future healing.

SUMMARY

It is to be understood that this summary is not an extensive overview of the disclosure. This summary is exemplary and not restrictive, and it is intended to neither identify key or critical elements of the disclosure nor delineate the scope thereof. The sole purpose of this summary is to explain and exemplify certain concepts of the disclosure as an introduction to the following complete and extensive detailed description.

In one aspect, disclosed is an ankle protection device comprising: an upper surface comprising a sloping portion having a substantially frustoconical shape, the sloping portion angled with respect to a flat portion of the lower surface at a slope angle measuring in the range of about 10 degrees to about 80 degrees; a lower surface distal from the upper surface; an upper cavity defined in the upper surface and sized to receive at least one of a medial malleolus and a lateral malleolus of a human ankle; a lower cavity defined in the lower surface; and a resilient material.

In a further aspect, disclosed is an ankle protection device comprising: an upper surface; a lower surface distal from the upper surface; a cavity defined in a one of the upper surface and the lower surface; and a resilient material.

In yet another aspect, disclosed is a method of using an ankle protection device comprising: positioning a lower surface of the ankle protection device on a sitting surface such that an upper surface of the ankle protection device faces upward; and resting a one of a medial malleolus and a lateral malleolus of the human ankle on the upper surface of the ankle protection device.

Various implementations described in the present disclosure may comprise additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims. The features and advantages of such implementations may be realized and obtained by means of the systems, methods, features particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

The accompanying drawings, which are incorporated in and constitute a part of this specification, illustrate several aspects of the disclosure and together with the description, serve to explain various principles of the disclosure. The drawings are not necessarily drawn to scale. Corresponding features and components throughout the figures may be designated by matching reference characters for the sake of consistency and clarity.

DETAILED DESCRIPTION

Figure 1:
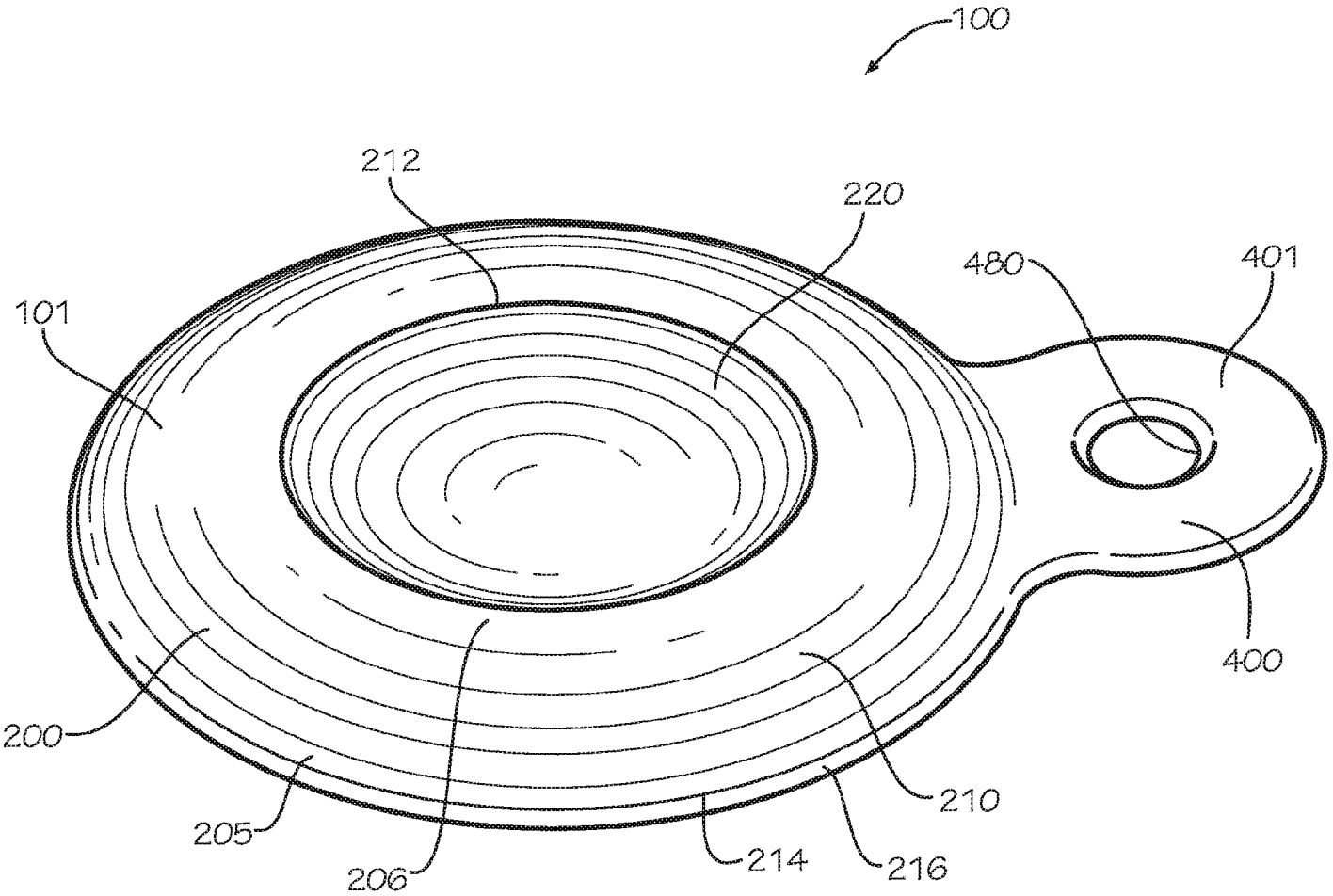
FIG. 1 is a perspective view of an ankle protection device in accordance with one aspect of the current disclosure.

The present disclosure can be understood more readily by reference to the following detailed description, examples, drawings, and claims, and their previous and following description. However, before the present devices, systems, and/or methods are disclosed and described, it is to be understood that this disclosure is not limited to the specific devices, systems, and/or methods disclosed unless otherwise specified, as such can, of course, vary. It is also to be understood that the terminology used herein is for the purpose of describing particular aspects only and is not intended to be limiting.

The following description is provided as an enabling teaching of the present devices, systems, and/or methods in their best, currently known aspect. To this end, those skilled in the relevant art will recognize and appreciate that many changes can be made to the various aspects described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to a quantity of one of a particular element can comprise two or more such elements unless the context indicates otherwise.

Ranges can be expressed herein as from "about" one particular value, and/or to "about" another particular value. When such a range is expressed, another aspect comprises from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance may or may not occur, and that the description comprises instances where said event or circumstance occurs and instances where it does not.

The word "or" as used herein means any one member of a particular list and also comprises any combination of members of that list.

To simplify the description of various elements disclosed herein, the conventions of "left," "right," "front," "rear," "top," "bottom," "upper," "lower," "inside," "outside," "inboard," "outboard," "horizontal," and/or "vertical" may be referenced. Unless stated otherwise, "rear" describes that end of the device nearest to the handle portion, if present; "front" is that end of the device that is opposite or distal the rear; "left" is that which is to the left of or facing left from the device from the perspective of a person facing towards the front of the device; and "right" is that which is to the right of or facing right from the device from the perspective of a person facing towards the front of the device. "Horizontal" or "horizontal orientation" describes that which is in a plane extending from left to right and which may be aligned with the horizon. "Vertical" or "vertical orientation" describes that which is in a plane that is angled at 90 degrees to the horizontal.

Various aspects of an ankle protection device and associated methods, systems, devices, and various apparatuses are disclosed herein. In various aspects, the ankle protection device can comprise an upper surface, a lower surface, and a cavity in a one of the upper surface and a lower surface. The upper surface can comprise a sloping portion having a substantially frustoconical shape.

An ankle protection device can prevent and repair the kind of problems noted above and other negative effects and provide a comfortable, attractive solution for those not wishing to adopt a completely new seating style, especially when such adoption would be counter to such individuals' culture.

FIG. 1 discloses an ankle protection device 100, which can be an ankle pad, an ankle cushion, or a cushioning pad. The ankle protection device 100 can comprise an upper surface 101 and a lower surface 102 (shown in FIG. 2) distal from the upper surface 101. The upper surface 101 and the lower surface 102 can together define a body portion 200 extending between the upper surface 101 and the lower surface 102. In one aspect, the upper surface 101 can comprise a sloping portion 210 having a substantially frustoconical shape and comprising a bottom end 205 and a top end 206. A frustoconical shape is typically understood to be the shape of a frustrum of a cone, where the frustrum is the portion of a cone (or pyramid or similar three-dimensional structure such as a polyhedron or any portion thereof) that remains after its upper part has been cut off by a plane parallel to its base, or that is intercepted between two such planes. In another aspect, the upper surface 101 or the body portion 200 can define another shape including, for example and without limitation, a cylindrical shape, a semispherical shape, a dome shape, or a parabolic shape, any of which can be "substantially" so shaped in spite of the presence of other surface features (e.g., local contouring or texturing of the surface).

Figure 7:
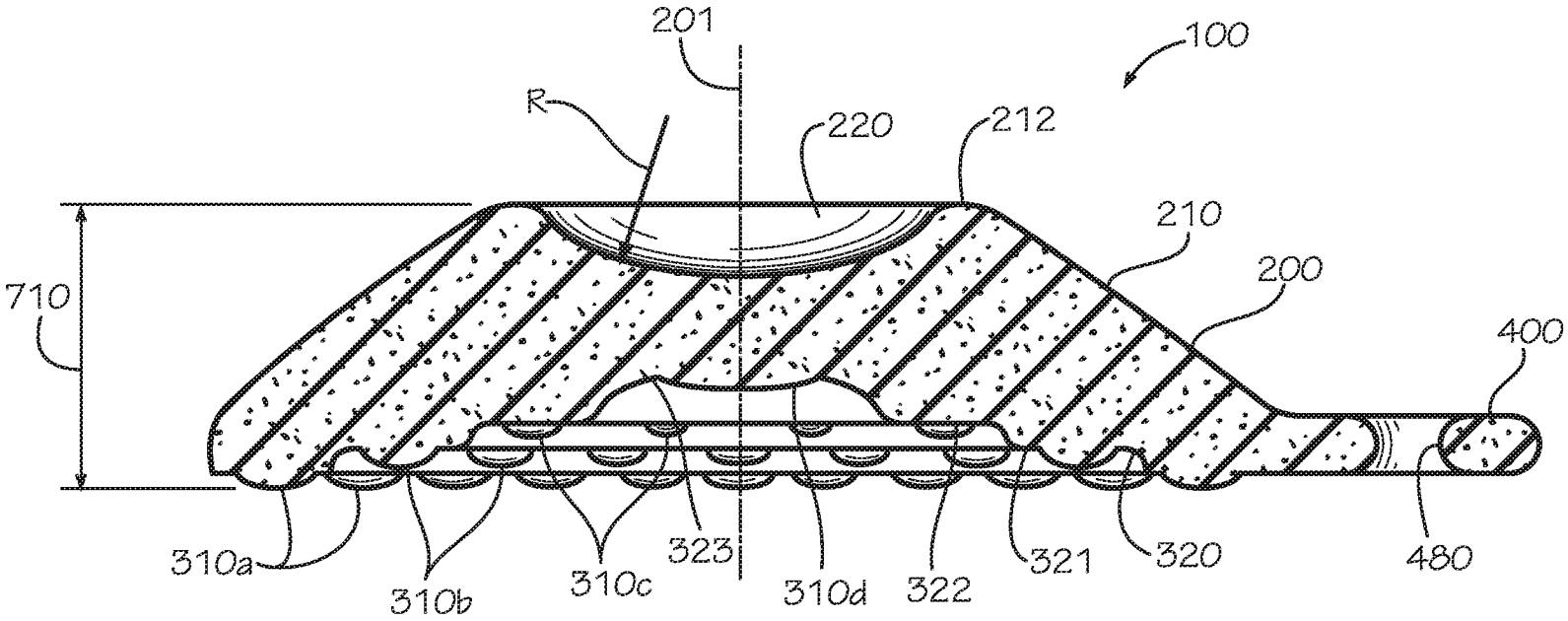
FIG. 7 is a sectional view of the ankle protection device of FIG. 1 taken along line 7-7 of FIG. 5.

To be "substantially" frustoconical can mean that the otherwise flat slides of the sloping portion 210 can have a slightly rounded surface in cross-section (such as shown in FIG. 7) or can mean to have surface features that break up an otherwise continuous flat or round surface. For example and without limitation, the upper surface 101 including the sloping portion 210 can define dimples (not shown) that can extend into the upper surface 101 (such as the dimpled cavities on the surface of a typical golf ball) or protrude outward from the upper surface 101 (such as the anti-suction elements shown in FIG. 2). The upper surface 101 can define such features while also defining a substantially frustoconical or other shape.

The ankle protection device 100 can further comprise a cavity or pocket defined in a one of the upper surface 101 and the lower surface 102. More specifically, the upper surface 101 can define an upper cavity 220. Likewise, the lower surface 102 can define a lower cavity 320 (shown in FIG. 6). The upper cavity 220 can define a concave surface intersecting with an outer edge 212 of the upper cavity 220. The outer edge 212 can also be an edge of the sloping portion 210 of the upper surface 101. In one aspect, the concave surface defined by the upper cavity 220 can have a radius R (shown in FIG. 7) in cross-section. In another aspect, the upper cavity 220 can have a variable radius in cross-section (i.e., with a larger radius towards an axis 201—shown in FIG. 2—of the body portion 200 or away from the axis 201). In yet another aspect, the upper cavity 220 can have a cylindrical shape (i.e., rectangular in cross-section). In yet another aspect, the upper cavity 220 can have an asymmetric or other irregular shape in cross-section.

Figure 10B:
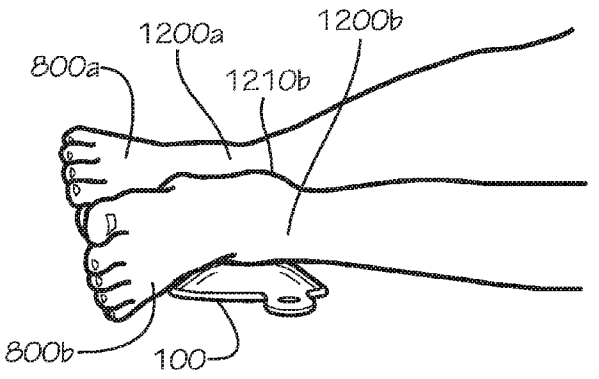
FIG. 10B is a perspective view of the user in the position shown in FIG. 10A with the ankle protection device of FIG. 1 positioned under each of the user's right ankle and left ankle.
Figure 10A:
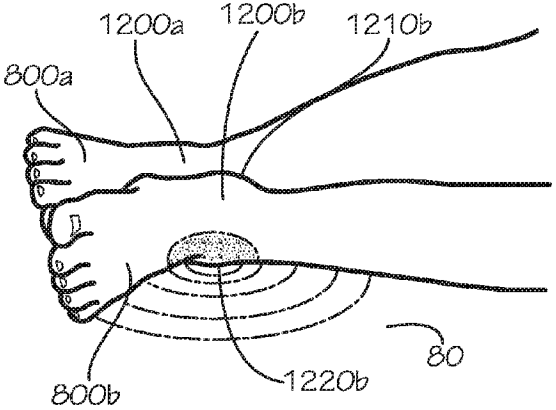
FIG. 10A is a perspective view of a pair of legs of a user sitting in another position without an ankle protection device.
Figure 12:
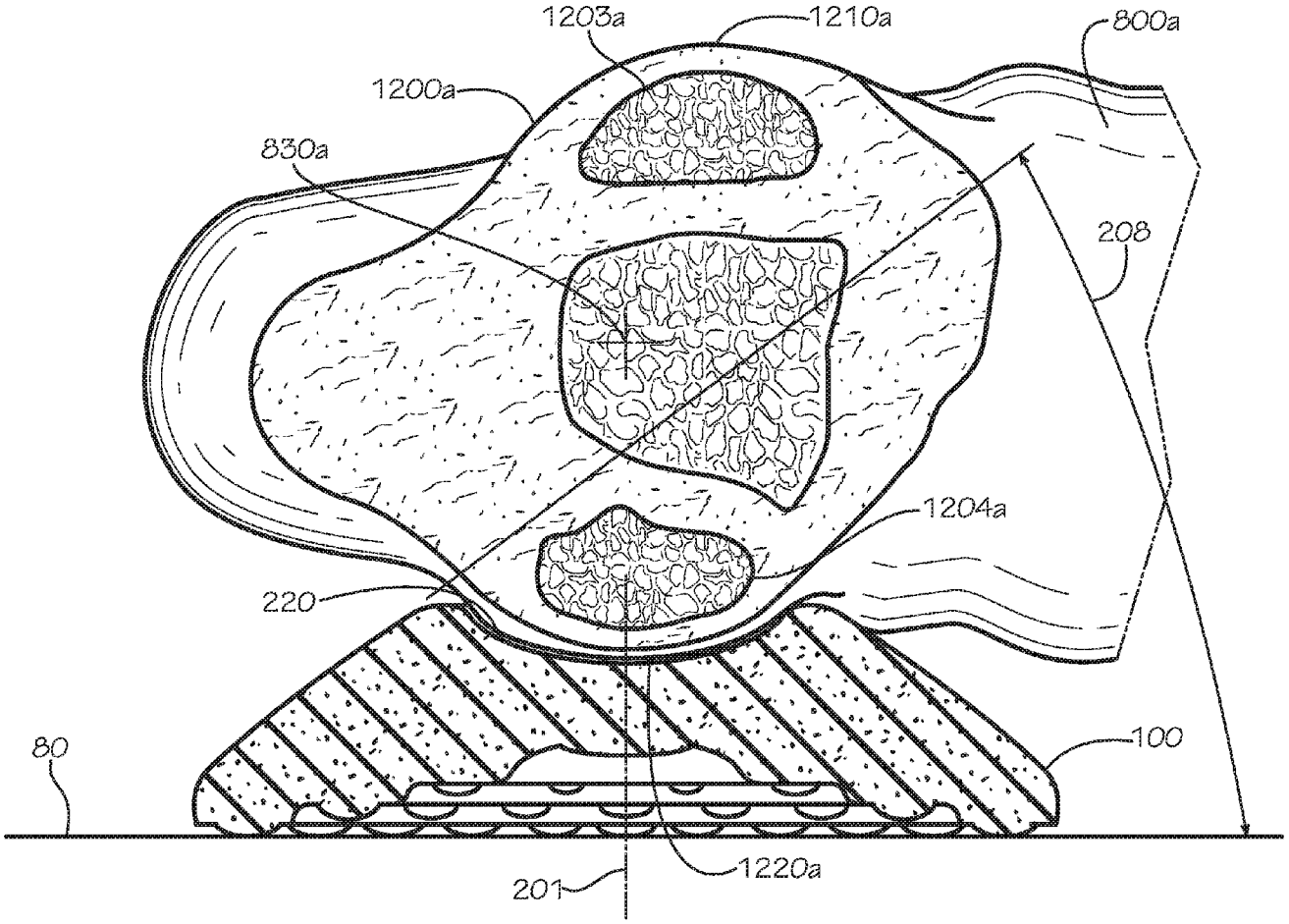
FIG. 12 is a sectional view of the ankle protection device of FIG. 1 taken along line 12-12 of FIG. 8B with the right ankle in contact with the ankle protection device but before compression of the ankle protection device.

In one aspect, the upper cavity 220 can be sized to receive a portion of a human ankle 1200*a,b* (shown in FIG. 10A). More specifically, the upper cavity 220 can be sized to receive at least one of a medial malleolus 1210*a,b* (1210*a* shown in FIG. 12, 1210*b* shown in FIG. 10A) and a lateral malleolus 1220*a,b* (1220*a* shown in FIG. 8A, 1220*b* shown in FIG. 10A) of a human ankle 1200*a,b*, respectively, where the medial malleolus 1210*a,b* of the typical ankle 1200*a,b* is formed by a leg bone called a tibia 1203*a,b* (1203*a* shown in FIG. 12, 1203*b* not shown), and the lateral malleolus 1210*a,b* is formed by a leg bone called a fibula 1204*a,b* (1204*a* shown FIG. 12, 1204*b* not shown). In another aspect, the upper cavity 220 can be sized to receive any other portion of the human body such as, for example and without limitation, a knee, an elbow, or a heel of a foot 800*a,b* (shown in FIG. 8A). Either the upper cavity 220 or the lower cavity 320 or both the upper cavity 220 and the lower cavity 320 can be aligned with the axis 201 of the body portion 200.

Figure 2:
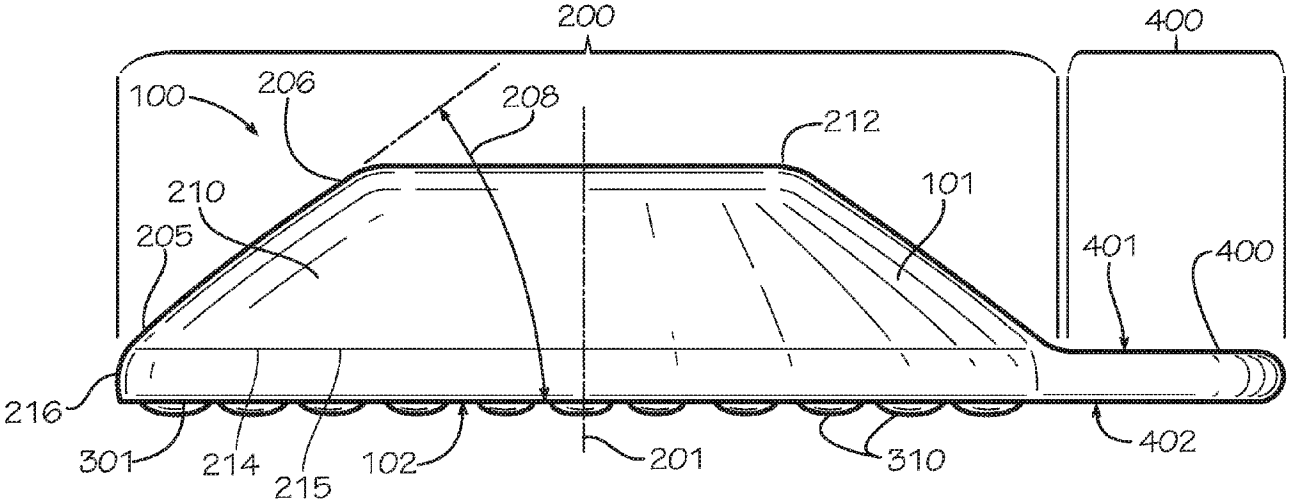
FIG. 2 is a side view of the ankle protection device of FIG. 1.

The ankle protection device 100 can further comprise a handle portion 400 extending from an outer edge of the body portion 200. In one aspect, the handle portion 400 can extend from an overall outer edge 216 of the body portion 200. In another aspect, the handle portion 400 can extend from a sloped portion outer edge 214, which can be coincident with the overall outer edge 216, or from any other portion of the body portion 200. The handle portion 400 can define a bore 480 extending from an upper handle surface 401 of the handle portion 400 to a lower handle surface 402 (shown in FIG. 2) of the handle portion 400, wherein the upper handle surface 401 can be defined in the upper surface 101 and the lower handle surface 402 can be defined in the lower surface 102. In one aspect, as shown, the handle portion 400 can be integrally formed with the body portion 200. In another aspect, the handle portion 400 can comprise a loop of material such as, for example, a piece of rope, that is secured to a hole (not shown) that can be defined in the body portion 200. The handle portion 400 can be used for storage, display, positioning, retrieval, transport, or accessorizing of the ankle protection device 100. As will be described, the bore 480 can further increase options for stowage and decoration of the ankle protection device 100. As shown in FIG. 2, the handle portion 400 can be made thinner than the body portion 200 to make the handle portion 400 less obtrusive and easily tethered to another object or person.

Figure 14:
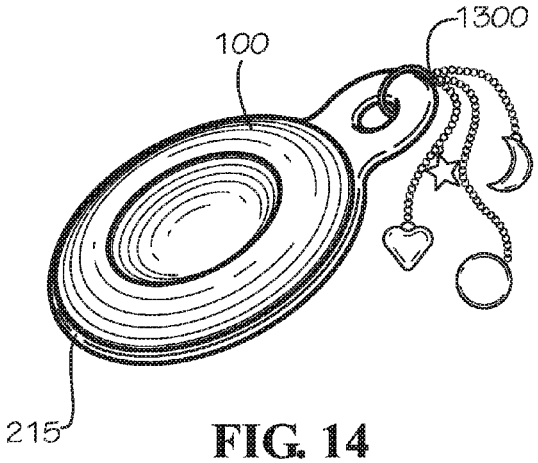
FIG. 14 is a perspective view of the ankle protection device of FIG. 1 with an accessory in accordance with another aspect of the current disclosure.
Figure 15:
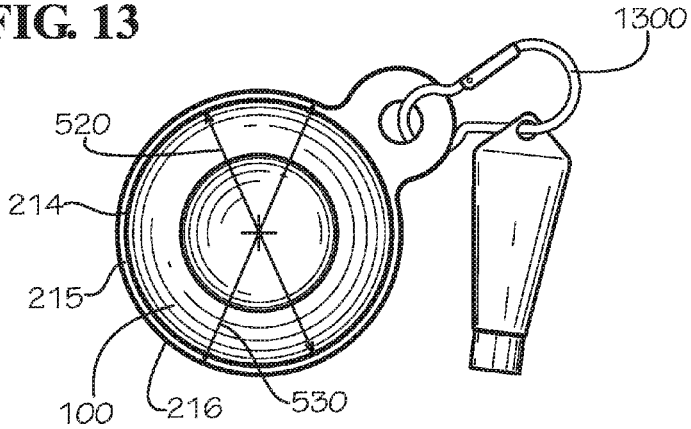
FIG. 15 is a top view of the ankle protection device of FIG. 1 with an accessory in accordance with yet another aspect of the current disclosure.

In one aspect, as also shown in FIG. 2, a surface of the sloping portion 210 when viewed in cross-section or when viewed from the side can be angled with respect to a base portion 301 of the lower surface 102 at a slope angle 208 measuring about 37 degrees. In another aspect, the slope angle 208 can measure in the range of about 35 degrees to about 40 degrees. In yet another aspect, the slope angle 208 can measure in the range of about 25 degrees to about 45 degrees. In another aspect, the slope angle 208 can measure in the range of about 10 degrees to about 80 degrees. In yet another aspect, the slope angle 208 can measure in the range of about 0 degrees to about 90 degrees (i.e., the sloping portion 210 can comprise a flat pad or a vertical wall surface). In yet another aspect, the ankle protection device 100 can define the upper cavity without the sloping portion 210 at all. Incorporation of the sloping portion 210 with a sufficient slope angle 208 can ensure the stability of the ankle protection device 100 under load, similar to the slope of an embankment under and extending from the foundation of a building. A sufficient slope angle 208 can also ensure the stability of the ankle protection device 100 when the ankle protection device 100 is being moved across a floor 80 (shown in FIG. 12). In one aspect, the slope angle 208 can measure the same value when a cross section of the ankle protection device 100 is taken along any vertical plane intersecting the axis 201 of the body portion 200 (such as shown in FIG. 12). In another aspect, the slope angle 208 can vary around the perimeter of the sloping portion 210. Where the sloping portion 210 is rounded, the sloping angle 208 can be measured to a tangent line or tangent plane of the sloping portion 210. In one aspect, as shown in FIGS. 14 and 15, the overall outer edge 216 can be offset radially outside from the sloped portion outer edge 214, forming a flange 215 (shown in FIGS. 14 and 15) around the perimeter of the body portion 200.

Figure 3:
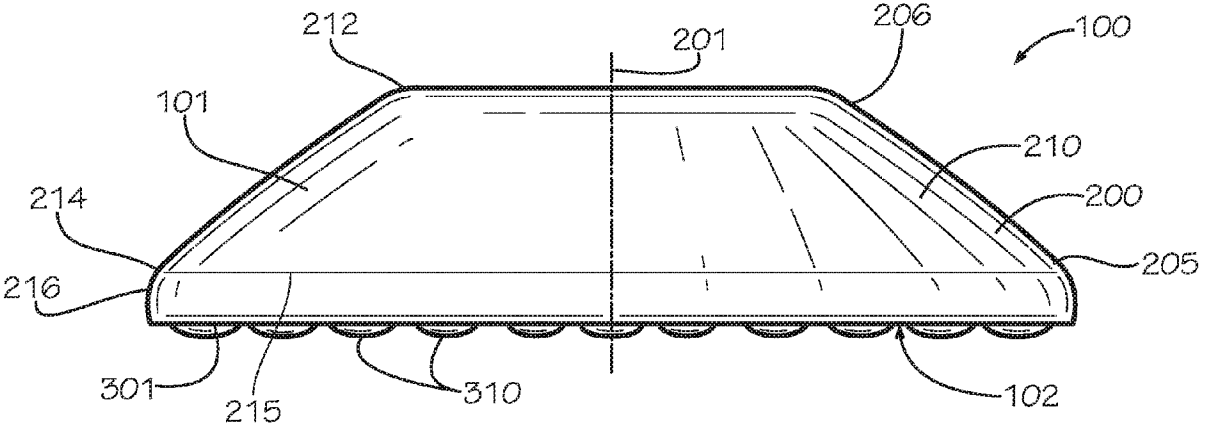
FIG. 3 is a front view of the ankle protection device of FIG. 1.
Figure 4:
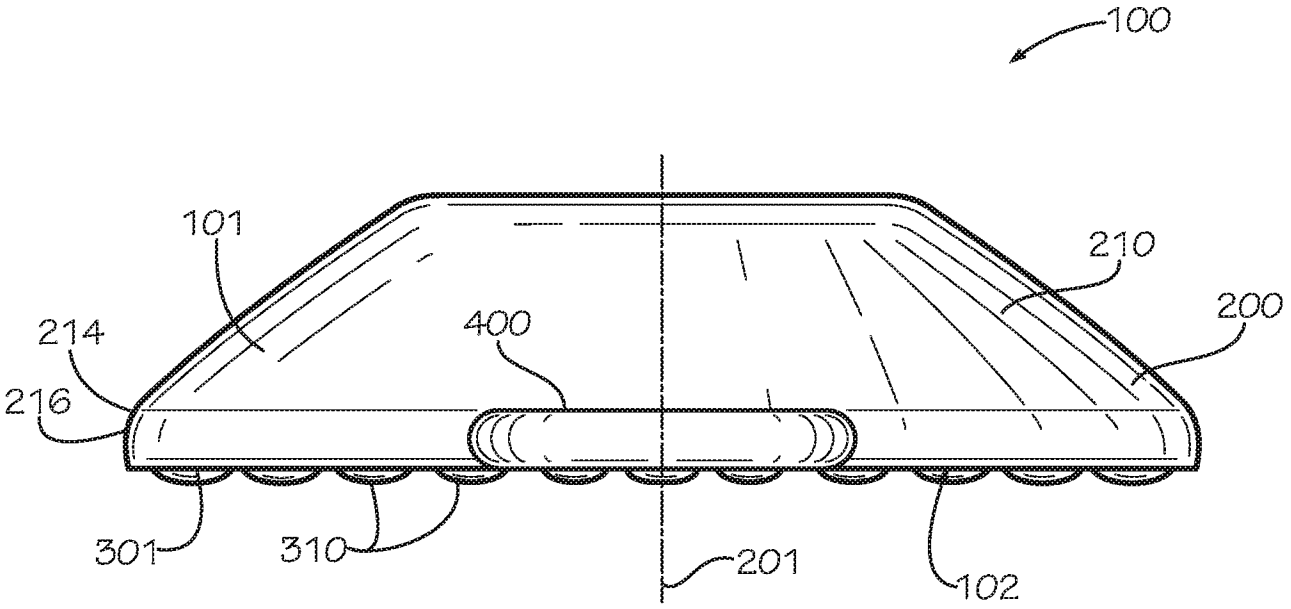
FIG. 4 is a rear view of the ankle protection device of FIG. 1.

As shown in FIGS. 2-4, the lower surface 102 of the ankle protection device 100 can define a plurality of anti-suction elements 310, each of which can be made to protrude from the base portion 301 of the lower surface 102. The anti-suction elements 310, which can be dimples, can be configured to allow free movement of ambient air to and from the lower cavity 320 (shown in FIG. 7) when a portion of the ankle protection device 100 is compressed against a surface such as the floor 80 by a force directed towards the upper surface 101. Such movement of air to and from the lower cavity 320 when a portion of the ankle protection device 100 is compressed against a surface such as the floor 80 can prevent the ankle protection device 100 from adhering to the floor 80. More specifically, the presence of the anti-suction elements 310 on the lower surface 102 can help prevent or break vacuum of any naturally occurring suction developed by the compression of the ankle protection device 100. In one aspect, as shown, the overall outer edge 216 can be approximately coincident with the sloped portion outer edge 214, such that no flange 215 is present around the perimeter of the body portion 200.

Figure 5:
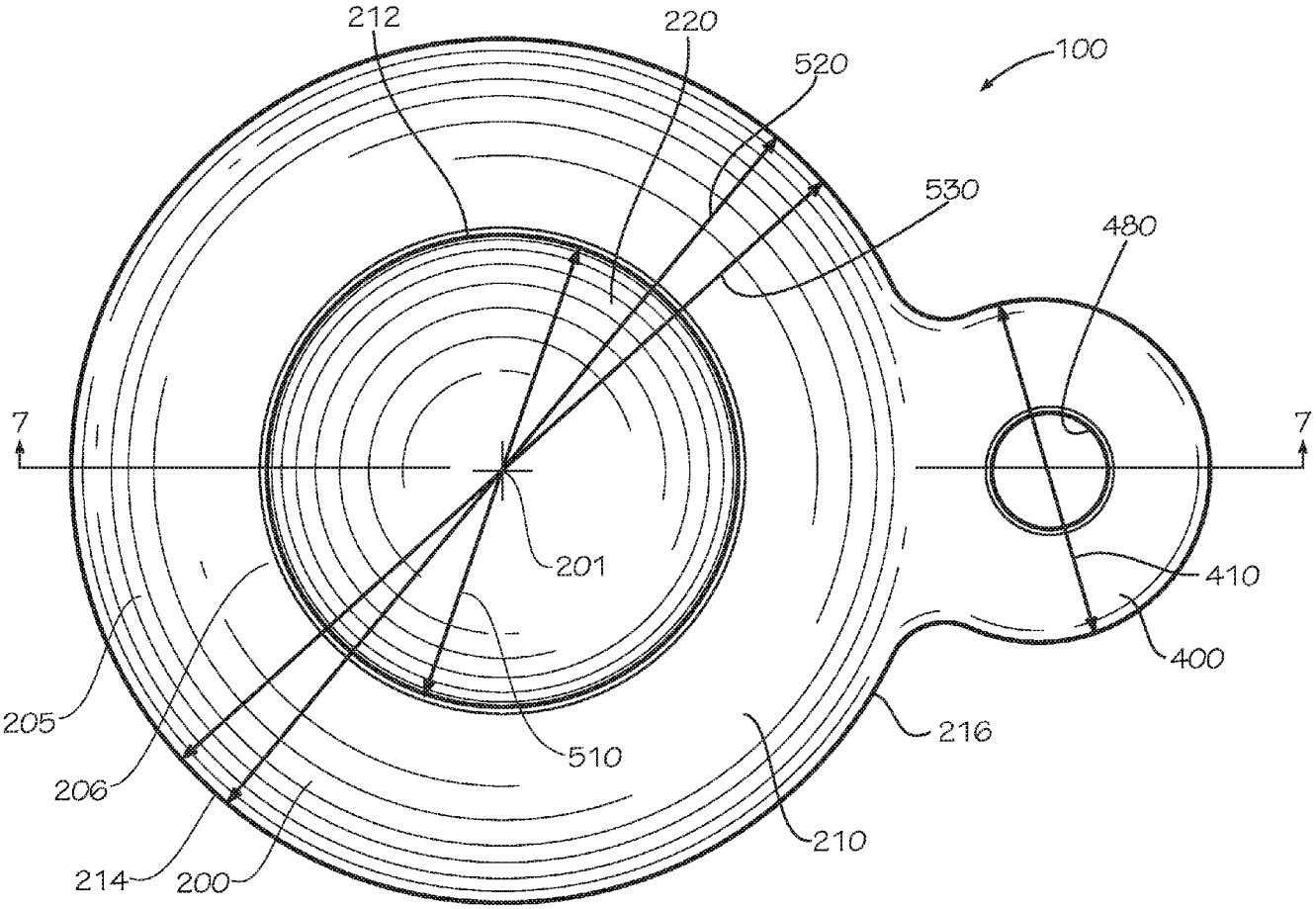
FIG. 5 is a top view of the ankle protection device of FIG. 1.

As shown in FIG. 5, a center of the upper cavity 220, which can lie on an axis of symmetry of the upper cavity 220, can be aligned with the axis 201 of the body portion 200. As shown, a center of the upper cavity 220 can also be concentric with any one or all of the sloping portion 210, the sloped portion outer edge 214, and the overall outer edge 216. The upper cavity 220 can define an upper cavity diameter 510. The sloped portion outer edge 214 can define a sloping portion base diameter 520. The overall outer edge 216 can define an outer diameter 530. In one aspect, as shown in FIG. 5, the outer diameter 530 can be substantially equal to the sloping portion base diameter 520, which can both be greater than the upper cavity diameter 510. In one aspect, as shown in FIG. 15, the outer diameter 530 can be greater than the sloping portion base diameter 520, which can be greater than the upper cavity diameter 510. In another aspect, the relationship between the upper cavity diameter 510, the sloping portion base diameter 520, and the outer diameter 530 can be otherwise.

In one aspect, a one of the sloping portion base diameter 520 and the outer diameter 530 can measure between three and four inches and a height 710 (shown in FIG. 7) of the body portion 200 can measure between about 0.5 and about 0.75 inches. In another aspect, a one of the sloping portion base diameter 520 and the outer diameter 530 can measure between about two and about four inches and the height 710 of the body portion 200 can measure between about 0.5 and about 1.0 inches. In yet another aspect, any of the sloping portion base diameter 520, the outer diameter 530, and the height 710 can be outside these ranges. Although a single version of the ankle protection device 100 can be made to accommodate different users, the ankle protection device 100 can also be produced in multiple sizes suitable for different body sizes and proportions such as, for example and without limitation, those commonly associated with men, women, and children, and in multiple sizes within those categories. In one aspect, a handle diameter 410 of the handle portion 400 can measure about one inch, and the bore 480 can measure about ¼" in diameter. In another aspect, the handle diameter 410 and the bore 480 can measure more or less than these values.

Figure 6:
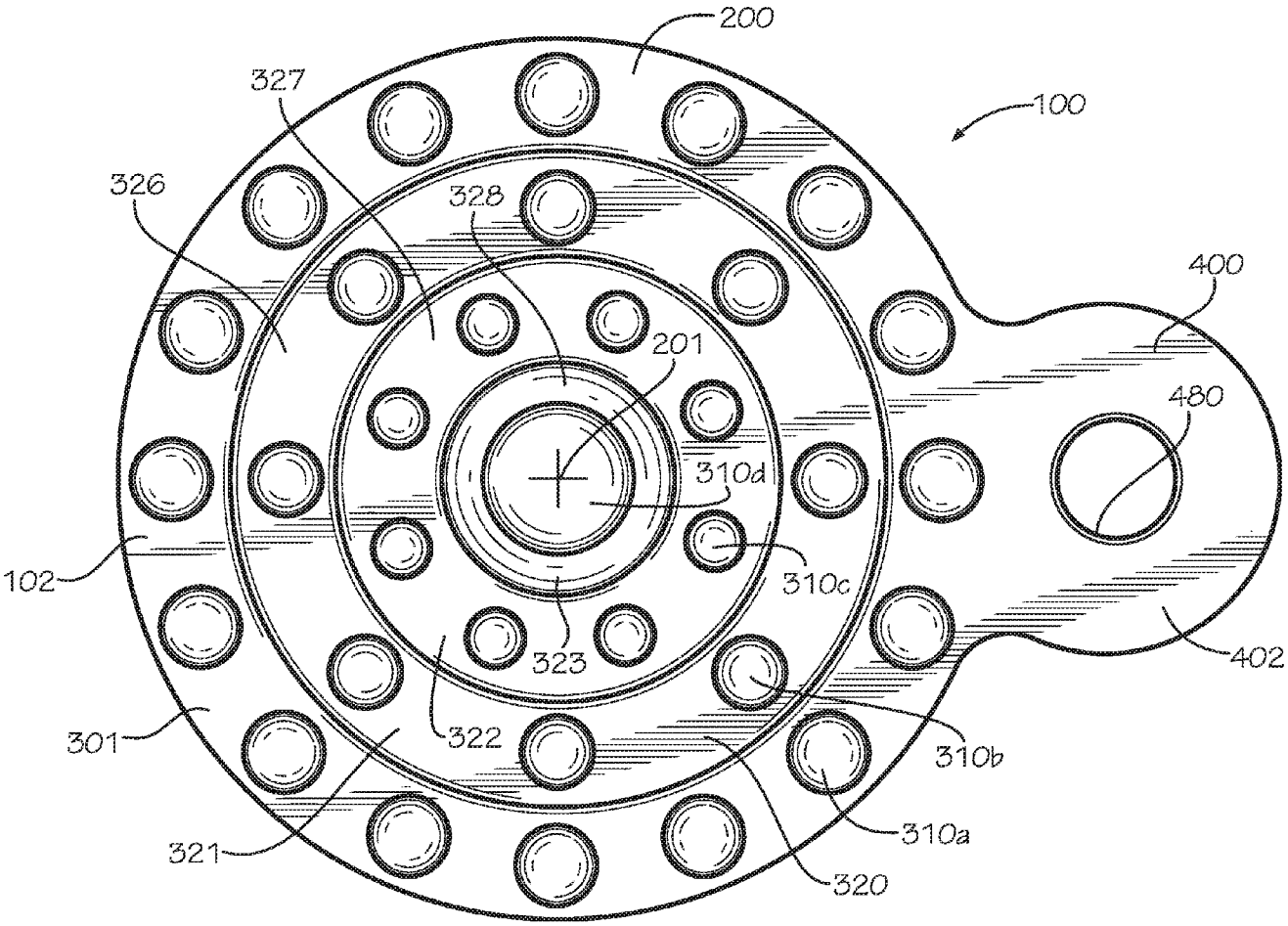
FIG. 6 is a bottom view of the ankle protection device of FIG. 1.

As shown in FIGS. 6 and 7, a center of the lower cavity 320, which can lie on an axis of symmetry of the lower cavity 320, can be aligned with the axis 201 of the body portion 200. The lower cavity 320 can define a multi-stage recess in the body portion 200 of the ankle protection device 100. More specifically, the lower cavity 320 can comprise any one or more of a first step portion 321, a second step portion 322, and a third step portion 323. The first step portion 321 can define a first step surface 326 offset vertically from the base portion 301, the second step portion 322 can define a second step surface 327 offset vertically from the first step portion 321, and the third step portion 323 can define a third step surface 328 offset vertically from the first step portion 321. As shown, a center of the lower cavity 320 can also be concentric with any one or all of the base portion 301, the first step portion 321, the second step portion 322, and the third step portion 323. With the presence of any one or all of the base portion 301, the first step portion 321, the second step portion 322, or the third step portion 323, compression and cushioning of the ankle protection device 100 is not limited to only the inherent compressibility of the foam material used to form the ankle protection device 100 but also the shape of the ankle protection device 100.

In one aspect, the anti-suction element 310 can extend from any one or more of the base portion 301, the first step portion 321, the second step portion 322, and the third step portion 323. More specifically, each of the base portion 301 and the lower cavity 320 can incorporate a plurality of anti-suction elements 310*a,b,c,d* arranged in a circumferential orientation around each of several step portions of the lower cavity 320. As shown, a plurality of the anti-suction elements 310*a* can extend from the base portion 301, a plurality of the anti-suction elements 310*b* can extend from the first step portion 321, a plurality of the anti-suction elements 310*c* can extend from the second step portion 322, and a plurality of the anti-suction elements 310*d* can extend from the third step portion 323. In various aspects, each of the anti-suction elements 310*a,b,c,d* can comprise a cushioning material. In various aspects, each of the anti-suction elements 310*a,b,c,d* can comprise an smooth surface. In various aspects, each of the anti-suction elements 310*a,b,c,d* can comprise an anti-skid surface configured to maintain the position of the ankle protection device 100.

In one aspect, each of the anti-suction elements 310*a,b,c,d* can define a dome shape. In another aspect, each of the anti-suction elements 310*a,b,c,d* can define another shape including, for example and without limitation, a cylindrical shape, a semispherical shape, a parabolic shape, or a frustoconical shape, any of which can be "substantially" so shaped by the presence of other surface features.

In one aspect, as shown, the body portion 200, when viewed from above or below as in FIG. 5 or 6, can have a round shape. In another aspect, the body portion 200, when so viewed, can have any other shape. Because the overall outer edge 216 can extend past the sloped portion outer edge 214, the overall shape of the body portion 200, when viewed from above or below, can be independent of the shape of the sloped portion 210.

The ankle protection device 100 can comprise a resilient material such as, for example and without limitation, compressible foam, which can be a closed-cell foam. A material that is resilient is one that is able to recoil, rebound, or spring back into shape after bending, stretching, or being compressed. More specifically, for example and without limitation, the ankle protection device 100 can comprise a soft, medium rebound, low density, non-stick, closed cell foam. By use of a non-stick material to form the ankle protection device 100 or by contouring or texturing a surface of the ankle protection device 100, the ankle protection device 100 can be made not to adhere to the skin of the user. Contouring or texturing a surface of the ankle protection device 100 can also result in the ankle protection device 100 feeling softer to the touch.

In one aspect, material forming the ankle protection device 100 can be homogeneous throughout. In another aspect, the ankle protection device 100 can comprise a multi-density foam (i.e., a foam that varies in density in different areas). In yet another aspect, the ankle protection device 100 can comprise a non-foam material such as, for example and without limitation, a rubber or gel material. Such a material can be placed without an internal pocket (not shown) of the ankle protection device 100 for cushioning. Any portion of the ankle protection device 100 can be molded with a surface texture that gives the ankle protection device 100 a non-stick surface. With a non-stick surface, the ankle protection device 100 can be made to resist scuffs and stains and have increased washability. The material used to form the ankle protection device 100 can comprise an anti-microbial agent such as, for example and without limitation, a MICROBAN antimicrobial agent available through Microban International, Ltd., of Huntersville, N.C, U.S.A., which can help inhibit the growth of bacteria and germs on the ankle protection device 100, thereby reducing the possibility of odor and/or disease.

In one aspect, the ankle protection device 100 can be molded using a molding process such as, for example and without limitation, injection molding. In another aspect, the ankle protection device 100 can be molded using any other suitable subtractive or additive manufacturing process. A surface of the ankle protection device 100 can be contoured or textured by machining or otherwise forming the surface of a molding tool or die of the molding process to produce such a surface.

Figure 8B:
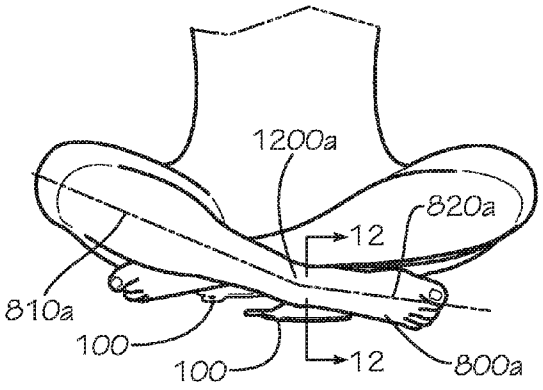
FIG. 8B is a perspective view of a user in the position shown in FIG. 8A with the ankle protection device of FIG. 1 positioned under each of the user's right ankle and left ankle.
Figure 8A:
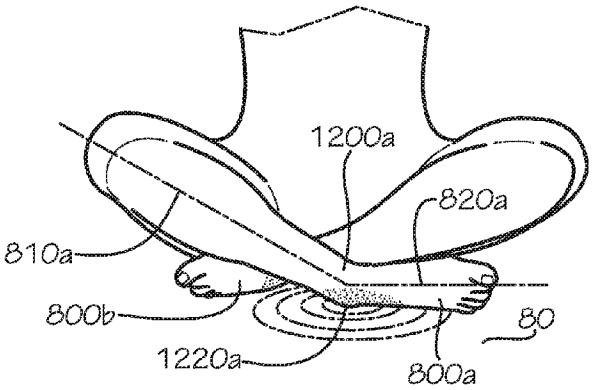
FIG. 8A is a perspective view of a user sitting cross-legged without an ankle protection device.

FIGS. 8A and 8B show how a person, sitting cross-legged on the floor, would appear with and without use of the ankle protection device 100. In FIG. 8A, the lateral malleolus 1220*a* of the person's right ankle 1200*a* is in contact with the floor 80. The pressure on the floor 80 and on the ankle 1200*a* is shown by the emanating lines on the floor 80 and the shaded area of the ankle 1200*a*. In addition, an axis 820*a,b* (820*b* not shown) of the foot 800*a* is clearly not aligned with an axis 810*a,b* (810*b* not shown) of the leg. In FIG. 8B, the lateral malleolus 1220*a* (hidden by a first ankle protection device 100) of the person's right ankle 1200*a* is in contact with and cradled by the first ankle protection device 100, which is in contact with and laying flat on the floor 80, and the lateral malleolus 1220*b* (hidden by a second ankle protection device 100) of the person's left ankle 1200*b* (hidden by the right leg) is in contact with and cradled by the second ankle protection device 100, which is also in contact with and laying flat on the floor 80. The pressure on the floor 80 is reduced by the wider contact surface of the ankle protection device 100, and the pressure on the ankle 1200*a* is reduced by the larger contact surface between the ankle protection device 100 and the ankle 1200*a* (shown in FIG. 12). Using the ankle protection device 100, the axis 820*a* of the foot 800*a* is more aligned with the axis 810*a* of the leg.

Figure 9B:
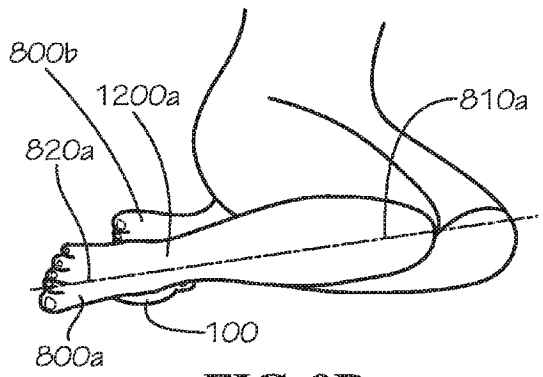
FIG. 9B is a perspective view of a user in the position shown in FIG. 9A with the ankle protection device of FIG. 1 positioned under each of the user's right ankle and left ankle.
Figure 9A:
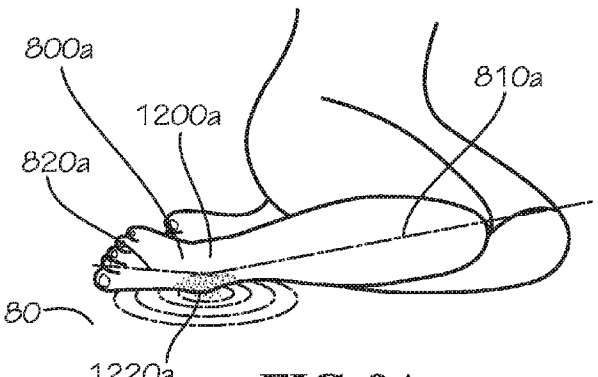
FIG. 9A is a perspective view of a user sitting side-legged without an ankle protection device.

FIGS. 9A and 9B show how a person, sitting side-legged on the floor, would appear with and without use of the ankle protection device 100. In FIG. 9A, the lateral malleolus 1220*a* of the person's right ankle 1200*a* is in contact with the floor 80. The pressure on the floor 80 and on the ankle 1200*a* is shown by the emanating lines on the floor 80 and the shaded area of the ankle 1200*a*. In addition, an axis 820*a* of the foot 800*a* is clearly not aligned with an axis 810*a* of the leg. In FIG. 9B, the lateral malleolus 1220*a* (hidden by the ankle protection device 100) of the person's right ankle 1200*a* is in contact with and cradled by the ankle protection device 100, which is in contact with and laying flat on the floor 80. The pressure on the floor 80 is reduced by the wider contact surface of the ankle protection device 100, and the pressure on the ankle 1200*a* is reduced by the larger contact surface between the ankle protection device 100 and the ankle 1200*a*. Using the ankle protection device 100, the axis 820*a* of the foot 800*a* is more aligned with the axis 810*a* of the leg.

FIGS. 10A and 10B show how a person, sitting side-legged on the floor or laying on the floor, would appear with and without use of the ankle protection device 100. In FIG. 10A, the lateral malleolus 1220*a* of the person's left ankle 1200*b* is in contact with the floor 80. The pressure on the floor 80 and on the ankle 1200*a* is shown by the emanating lines on the floor 80 and the shaded area of the ankle 1200*a*. In FIG. 10B, the lateral malleolus 1220*b* of the person's left ankle 1200*b* (hidden by the ankle protection device 100) is in contact with and cradled by the ankle protection device 100, which is in contact with and laying flat on the floor 80. The pressure on the floor 80 is reduced by the wider contact surface of the ankle protection device 100, and the pressure on the ankle 1200*a* is reduced by the larger contact surface between the ankle protection device 100 and the ankle 1200*a*.

Figure 11B:
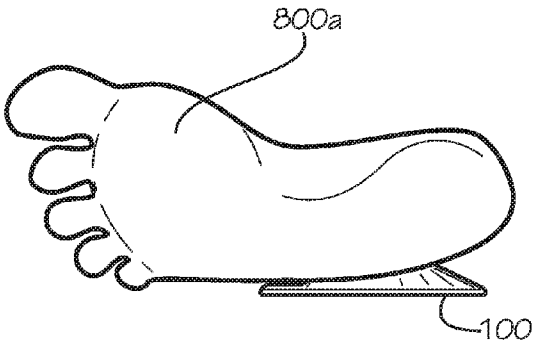
FIG. 11B is a perspective view of a user in the position shown in FIG. 11A with the ankle protection device of FIG. 1 positioned under the user's right ankle.
Figure 11A:
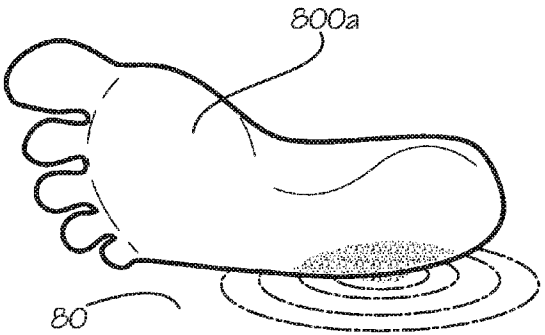
FIG. 11A is a perspective view of a foot of a user sitting in another position without an ankle protection device.

FIGS. 11A and 11B show how a foot 800*a* would appear with and without use of the ankle protection device 100. In FIG. 11A, the foot 800*a* is in contact with the floor 80. The pressure on the floor 80 and on the foot 800*a* is shown by the emanating lines on the floor 80 and the shaded area of the foot 800*a*. In FIG. 11B, the lateral malleolus 1220*a* of the person's right ankle 1200*a* (hidden by the ankle protection device 100) is in contact with and cradled by the ankle protection device 100, which is in contact with and laying flat on the floor 80. The pressure on the floor 80 is reduced by the wider contact surface of the ankle protection device 100, and the larger contact surface between the ankle protection device 100 and the foot 800*a,b* reduces the pressure on the foot 800*a,b*.

As shown in FIG. 12, the ankle 1200*a* of a person sitting on the floor (shown in FIG. 8B) can rest in the upper cavity 220, which again can be sized to receive at least one of the medial malleolus 1210*a,b* or inside bony protrusion of the ankle and the lateral malleolus 1220*a,b* or outside bony protrusion of the ankle 1200*a,b,* respectively. Also shown is the tibia 1203*a*, the fibula 1204*a*, and surrounding soft tissue. As shown, as similarly can be seen in the bones and soft tissue in the front of the knee joint (not shown) and the rear of the elbow joint (not shown), the soft tissue of the ankle 1200*a* between the tibia 1203*a* and the skin and the soft tissue of the ankle 1200*a* between the fibula 1204*a* and the skin is relatively thin in comparison with the soft tissue in other areas of the ankle.

The ankle 1200*a,b* can define a joint center 830*a,b* (830*b* not shown), which is where the axis 810*a,b* of the leg and the axis 820*a,b* of the foot 800*a,b,* respectively, intersect. In one aspect, the ankle 1200*a,b* can be centered in and cradled within the upper cavity 220 and the joint center 830 can be positioned directly over the axis 201 so that the weight of the ankle 1200*a,b* and any other load transferred through the ankle 1200*a,b* can be evenly supported by all sides of the ankle protection device 100. When evenly supported by all sides of the ankle protection device 100, the ankle protection device 100 can be compressed evenly and progressively and the supported weight can be absorbed and transferred evenly through the ankle protection device 100. By compressing "progressively," the ankle protection device 100 provides greater resistance to the load as the load on the ankle protection device 100 increases.

A method of using the ankle protection device 100 can comprise: positioning the lower surface 102 of the ankle protection device 100 on a sitting surface such as the floor 80 such that an upper surface 101 of the ankle protection device 100 faces upward; and resting a one of the medial malleolus 1210*a,b* and the lateral malleolus 1220*a,b* of the human ankle 1200*a,b* on the upper surface 101 of the ankle protection device 100. Resting the one of the medial malleolus 1210*a,b* and the lateral malleolus 1220*a,b* on the upper surface 101 of the ankle protection device 100 comprises positioning the one of the medial malleolus 1210*a,b* and the lateral malleolus 1220*a,b* in the upper cavity 220. The method can further comprise moving the ankle protection device 100 across the sitting surface with the ankle 1200*a,b* by pushing the ankle protection device 100 with the ankle 1200*a,b*. The method can further comprise compressing the body portion 200 so that the first step portion 321 contacts the sitting surface. The method can further comprise compressing the body portion 200 so that the second step portion 322 or the third step portion 323 contacts the sitting surface. Where the ankle protection device 100 is a first ankle protection device 100 of a pair of ankle protection devices 100, the method can further comprise connecting the first ankle protection device 100 to a one of a second ankle protection device 100 and an accessory 1300.

As a portion of the user's ankle 1200*a,b* such as the medial malleolus 1210*a,b* or the lateral malleolus 1220*a,b* comes to rest in the upper cavity 220, the material of the ankle protection device 100 can be configured to compress first. Then as the load increases on the ankle protection device 100, the first step portion 321 of the lower cavity 320 can be configured to compress or collapse next so that the first step portion 321 then contacts the floor 80. Then as the load increases still more on the ankle protection device 100, the second step portion 322 can be configured to compress or collapse so that the second step portion 322 contacts the floor 80. Then as the load further increases still more on the ankle protection device 100, the third step portion 323 can be configured to compress or collapse so that the third step portion 323 contacts the floor 80. For example, in a typical cross-legged seating position, should the user rotate forward to pick up or look at something such as a bowl of food, the ankles 1200*a,b* can experience a momentary rise in stress due to the user's upper body weight shifting over the ankles 1200*a,b*. In such a situation, the ankle protection device 100 can continue to depress further until another level of support is reached. This adaptive aspect of the multi-stage convex lower cavity 320 allows the ankle protection device 100 to maintain maximum support and protection over a wide range of circumstances.

Positioning the lower surface 102 on the floor 80 can comprise the dimples 310*a* but not the base portion 301 contacting the floor 80. The first step portion 321 contacting the floor 80 can comprise the dimples 310*b* but not the first step surface 326 contacting the floor 80. The second step portion 322 contacting the floor 80 can comprise the dimples 310*c* but not the second step surface 327 contacting the floor 80. The third step portion 323 contacting the floor 80 can comprise the dimples 310*d* but not the third step surface 328 contacting the floor 80. The dimples 310 can be configured to compress at any point before, during, or after the compression of the first step portion 321, the second step portion 322, or the third step portion 323.

The sloped portion 210 of the body portion 200 can make it possible for the user to "blindly" position the ankle protection device 100 under their legs and feet. More specifically, the user can instantly feel or detect the location of the ankle protection device 100 in relationship to their ankle 1200*a,b,* thus establishing an immediate sense of reference. Because of the shape of the sloped portion 210, especially when it is uniform and concentric about the axis 201, the user, once he or she has made contact with the ankle protection device 100, has only to ascend the sloped portion 210 to the upper cavity 220. If the user loses the position of the upper cavity 220 while seated, he or she need only repeat the aforementioned process. The user can move his or her ankle 1200*a,b* using the muscles of the leg or by pushing his or her ankle 1200*a,b* with his or her hand. The upper cavity 220 itself can help the user know when his or her ankle 1200*a,b* is correctly centered over the thickest part of the ankle protection device 100 before putting weight down on the ankle protection device 100. The upper cavity 220 can further cause the ankle protection device 100 to follow the user during movement of the ankle 1200*a,b*.

As stated previously, the ankle protection device 100 can reduce or eliminate the pain, discoloration, scarring, disfigurement, and other damage that can occur due to prolonged stress on the ankle and surrounding tissues when sitting in either a cross-legged or side-legged position. Inherent to these and other seating positions, for example and without limitation, the inner bony protrusion and the outer bony protrusion of the ankles 1200*a,b* and surrounding tissue can experience stress when in contact with earthen or other harsh surfaces for prolonged periods. The ankle protection device 100 can reduce these stresses by preventing the ankle 1200*a,b* and surrounding tissues from directly contacting these harsh surfaces at all. The ankle protection device 100 can also reduce these stresses by, for example and without limitation, distributing the contact force across a surface area of the ankle 1200*a,b* by conforming the shape of the upper cavity 220 to the shape of the one of the bony protrusions, i.e., the medial malleolus 1210*a,b* or the lateral malleolus 1220*a,b* of the human ankle 1200*a,b*. Furthermore, increased weight on the ankle protection device 100 can cause the deformed shape of the upper cavity 220 to even more closely match, if not perfectly match, the shape of the ankle 1200*a,b* in contact with the ankle protection device 100. A closer match between the surfaces of the ankle 1200*a,b* and the upper cavity 220 can increase the contact surface area and further reduce the pressure in any one area. In contrast, the medial malleolus 1210*a,b* or the lateral malleolus 1220*a,b* of the human ankle in contact with the floor 80 can produce a relatively high force over the relatively small area of the ankle 1200*a,b* in contact with the floor 80.

The ankle protection device 100 can also help correct ankle and leg posture by decreasing the amount of angularity experienced during seating by, for example and without limitation, lifting the ankle 1200*a,b* off from the sitting surface. For example, the method of using the ankle protection device 100 can further comprise lifting the ankle 1200*a,b* off from a sitting surface such as the floor 80 so that the axis 810*a,b* of the leg and the axis 820*a,b* of the respective foot 800*a,b* are more closely aligned.

These and other features of the ankle protection device 100 can make possible more relaxed, longer seated sessions, while promoting greater blood flow and oxygenation to the affected areas of the human body. Such a result can also improve the skin tone and allow affected tissues to heal.

Figure 13:
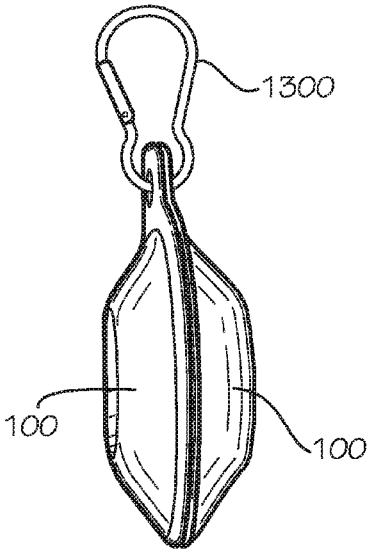
FIG. 13 is a perspective view of a pair of the ankle protection devices of FIG. 1 with an accessory.
Figure 16:
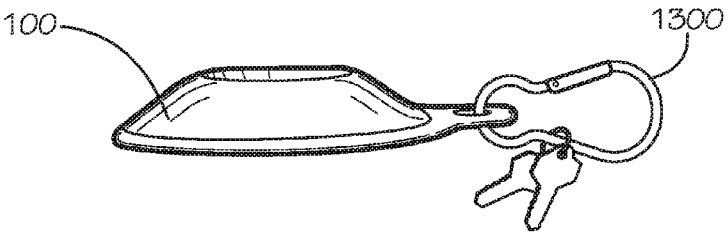
FIG. 16 is a perspective view of the ankle protection device of FIG. 1 with an accessory in accordance with yet another aspect of the current disclosure.

As shown in FIGS. 13-16, the ankle protection device 100 can be attached to an accessory 1300. FIG. 13 shows the accessory 1300, which as shown can comprise a carabineer, connecting two ankle protection devices 100 to each other. FIG. 14 shows the accessory 1300, which as shown can comprise a charm or other piece of jewelry attached to the ankle protection device 100. FIG. 15 shows the accessory 1300, which can comprise the carabineer and a bottle of ointment or lotion as shown. FIG. 16 shows the accessory 1300, which as shown can comprise the carabineer and a key or keys attached to the ankle protection device 100. A method of using the ankle protection device 100 can comprise attaching the accessory 1300.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily comprise logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which comprise one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. An ankle protection device comprising:

an upper surface comprising a sloping portion having a substantially frustoconical shape, the sloping portion angled with respect to a base portion of the lower surface at a slope angle measuring in a range of about 10 degrees to about 80 degrees;

a lower surface distal from the upper surface;

an upper cavity defined in the upper surface and sized to receive at least one of a medial malleolus and a lateral malleolus of a human ankle, the upper cavity defining an axis aligned with an axis of the body portion of the ankle protection device, the body portion defined by the upper surface and the lower surface of the ankle protection device;

a lower cavity defined in the lower surface;

a handle portion extending from the body portion of the ankle protection device proximate to a base portion of the lower surface in a direction angled with respect to the axis of the body portion, a thickness of the handle portion of the ankle protection device being less than a maximum height of the ankle protection device; and a resilient material;

wherein the body portion and the handle portion are integrally formed from the resilient material.

2. The device of claim 1, wherein in cross-section a surface of the sloping portion is angled with respect to the base portion of the lower surface at a slope angle measuring in a range of about 25 degrees to about 45 degrees.

3. The device of claim 1, wherein the upper cavity defines a concave surface intersecting with an outer edge of the upper cavity.

4. The device of claim 1, wherein the lower surface defines a plurality of anti-suction elements, each of the plurality of anti-suction elements extending independently from the base portion of the lower surface, each of the plurality of anti-suction elements spaced apart on the base portion, the base portion and each pair of adjacent anti-suction elements of the plurality of anti-suction elements defining a space therebetween, the space between each pair of adjacent anti-suction elements configured to allow free movement of ambient air to and from the lower cavity when the ankle protection device is compressed against a substantially flat surface by a force directed towards the upper surface.

5. The device of claim 1, wherein the handle portion defines a bore extending from the upper surface to the lower surface, the handle portion defines a diameter measuring less than a diameter of the body portion, and the resilient material forming both the body portion and the handle portion comprises one of a foam, a rubber, and a gel material.

6. The device of claim 1, wherein the lower cavity comprises a first step portion and a second step portion; the first step portion defining a first step surface offset from the base portion, the second step portion defining a second step surface offset from the first step portion.

7. An ankle protection device comprising:

an upper surface;

a lower surface distal from the upper surface, the lower surface defining a plurality of anti-suction elements, each of the plurality of anti-suction elements defining a rounded shape, each of the plurality of anti-suction elements extending independently from a substantially flat base portion of the lower surface, each of the plurality of anti-suction elements spaced apart on the base portion, the base portion and each pair of adjacent anti-suction elements of the plurality of anti-suction elements defining a space therebetween;

an upper cavity defined in the upper surface;

a lower cavity defined in the lower surface, the space between each pair of adjacent anti-suction elements of the plurality of anti-suction elements configured to allow free movement of ambient air to and from the lower cavity when the ankle protection device is compressed against a substantially flat surface by a force directed towards the upper surface; and a resilient material.

8. The device of claim 7, wherein the upper surface comprises a sloping portion having a substantially frustoconical shape.

9. The device of claim 8, wherein the plurality of anti-suction elements are arranged in a circular pattern on a one of the base portion, a first step portion, and a second step portion of the lower surface of the ankle protection device, the circular pattern of the plurality of anti-suction elements concentric with the lower cavity, the space between each pair of adjacent anti-suction elements of the plurality of anti-suction elements configured to allow free movement of ambient air to and from the lower cavity in a radial direction from the lower cavity.

10. The device of claim 7, wherein the resilient material comprises a closed cell foam material comprising an anti-microbial agent.

11. The device of claim 7, wherein and the lower cavity comprises a first step portion and a second step portion; the first step portion defining a first step surface offset from the base portion, the second step portion defining a second step surface offset from the first step portion, and the base portion, the first step surface, and the second step surface parallel to each other.

12. The device of claim 7, further comprising a handle portion defining a bore extending from the upper surface to the lower surface, a thickness of the handle portion of the ankle protection device being less than a maximum height of the ankle protection device.

13. The device of claim 7, wherein the upper cavity is sized to receive a one of a medial malleolus and a lateral malleolus of a human ankle.

14. The device of claim 13, wherein the upper cavity defines a concave surface intersecting with an outer edge of the upper cavity.

15. The device of claim 7, wherein the lower surface defining a plurality of anti-suction elements configured to allow movement of ambient air to and from the lower cavity when a portion of the device is compressed against a surface by a force directed towards the upper surface.

16. A method of using a first ankle protection device and a second ankle protection device, the method comprising:

connecting the first ankle protection device to the second ankle protection device with an accessory, the accessory extending through a bore defined in each of the first ankle protection device and the second ankle protection device;

carrying the first ankle protection device and the second ankle protection device, the first ankle protection device and the second ankle protection device carried by an ambulatory user of the first ankle protection device and the second ankle protection device;

positioning a lower surface of a one of the first ankle protection device and the second ankle protection device on a sitting surface such that an upper surface of the one of the first ankle protection device and the second ankle protection device faces upward; and resting a one of a medial malleolus and a lateral malleolus of an ankle of the user on the upper surface of the one of the first ankle protection device and the second ankle protection device, wherein the user is sitting on the sitting surface.

17. The method of claim 16, wherein the upper surface of each of the first ankle protection device and the second ankle protection device further defines an upper cavity, and wherein resting the one of the medial malleolus and the lateral malleolus on the upper surface of the one of the first ankle protection device and the second ankle protection device comprises positioning the one of the medial malleolus and the lateral malleolus in the upper cavity of the one of the first ankle protection device and the second ankle protection device.

18. The method of claim 17, further comprising moving the one of the first ankle protection device and the second ankle protection device across the sitting surface with the ankle by pushing the one of the first ankle protection device and the second ankle protection device with the ankle.

19. The method of claim 16, wherein the lower surface of each of the first ankle protection device and the second ankle protection device comprises a base portion and defines a lower cavity, the lower cavity comprising a first step portion defining a first step surface offset from the base portion, the method further comprising compressing the body portion of the one of the first ankle protection device and the second ankle protection device so that the first step surface contacts the sitting surface.

20. The method of claim 16, wherein the bore of the first ankle protection device is defined in a handle portion of the first ankle protection device and the bore of the second ankle protection device is defined in a handle portion of the second ankle protection device, wherein the accessory is a carabiner extending through a bore defined in the handle portion of the first ankle protection device and through a bore defined in the handle portion of the second ankle protection device, a thickness of the handle portion of the first ankle protection device less than a maximum height of the first ankle protection device and a thickness of the handle portion of the second ankle protection device being less than a maximum height of the second ankle protection device.

* * * * *